United States Patent [19]

Lin et al.

[11] Patent Number: 5,070,566

[45] Date of Patent: Dec. 10, 1991

[54] HYBRID BRIDGE STRUCTURE

[75] Inventors: Tung-Yen Lin, El Cerrito; Philip Y. Chow, Orinda, both of Calif.

[73] Assignee: T. Y. Lin International, San Francisco, Calif.

[21] Appl. No.: 605,267

[22] Filed: Oct. 29, 1990

[51] Int. Cl.[5] ..... E01D 11/00; E01D 19/02

[52] U.S. Cl. ..... 14/19; 14/18; 14/21

[58] Field of Search ..... 14/18, 19, 21, 22

[56] References Cited

U.S. PATENT DOCUMENTS

| | | | |
|---|---|---|---|
| 1,453,084 | 4/1923 | Strauss | 14/19 |
| 1,592,685 | 7/1926 | Schachenmeier | 14/19 |
| 2,641,784 | 6/1953 | Templeton | 14/19 |
| 4,866,803 | 9/1989 | Nedelcu | 14/19 |

FOREIGN PATENT DOCUMENTS

| | | | |
|---|---|---|---|
| 590940 | 4/1934 | Fed. Rep. of Germany | 14/18 |

*Primary Examiner*—Ramon S. Britts
*Assistant Examiner*—Nancy P. Connolly
*Attorney, Agent, or Firm*—Owen, Wickersham & Erickson

[57] ABSTRACT

A hybrid bridge construction comprises a pair of piers enclosed in the earth at a fixed predetermined distance apart with a cantilever section supported on each pier. Each cantilever section comprises one or more vertical towers with a pair of inner and outer rigid compression members fixed to and extending upwardly and outwardly from the base of each tower. Outer tension members are attached to the top portions of each tower and to upper end portions of the compression members. A suspension section interconnecting the cantilever sections comprises catenary cable members attached to the upper end portions of inner compression members. A road deck extends between the piers, and vertical suspender members extend between the cable members and the road deck.

12 Claims, 3 Drawing Sheets

HYBRID BRIDGE STRUCTURE

This invention relates to bridge structures, and more particularly to a combined suspension and cantilever structure that overcomes the span length limitation of a long-span suspension bridge.

BACKGROUND OF THE INVENTION

A suspension bridge is a bridge that is supported by cable suspenders hanging from main catenary cables that are strung from one pier to the next. This type of bridge has been constructed commonly for long spans of the order of 5,000 feet. Longer spans up to 6,500 feet have been constructed in recent years, and spans of 10,000 feet have been planned. However, span length increases of conventional suspension bridges are subject to a serious material limitation, i.e. the reduction of the carrying capacity/weight ratio of the catenary cables (C/W ratio for short) occurring with the increase of span length. For example, a suspension bridge with a C/W ratio of three means that for this bridge, every pound of steel in the catenary cables will carry three pounds of bridge load in addition to its own weight. A suspension bridge with a main span of 5,000 feet, usually has a C/W ratio of around 5 or 6.

As the bridge increases in span length, the C/W ratio will decrease at a rate depending on the geometry, material strength, etc. At a span length of 16,000 feet, for example, the C/W ratio would drop to about 1:1, meaning a carrying capacity of only one pound for every pound of steel used in the catenary cables. This will not only place a limit on how long a suspension bridge can be, it will also result in a very inefficient and uneconomic design.

The invention herein disclosed enables the span length of a suspension bridge to be increased substantially without reducing the carrying capacity of the catenary cables. For example, a 16,000-foot bridge span as cited above, when utilizing the present invention, will maintain a carrying capacity of the catenary cables at a C/W ratio of 3 or 4, as if the bridge span is only 10,000 feet long. The practical limit of suspension bridge spans will thus be raised from about 16,000 feet using prior art principles to 22,000 feet.

SUMMARY OF THE INVENTION

In accordance with the principles of the invention, a hybrid bridge structure is provided which combines a central suspension bridge section with a "double" or "balanced" cantilever bridge section at each opposite end of the central section. Each balanced cantilever bridge section is of the type comprising a central pier with cantilevers extending simultaneously and incrementally outward from both sides of the pier so that they are in balance about the pier. The cantilever sections provide the support at each end of the central suspension bridge section. By this means, the length of the suspension section that would otherwise have reached its length limit, can be increased by adding to it the span length contributed by the two cantilever sections.

The cantilever bridge sections can be provided in various shapes and forms, but in general, each comprises a central pier having an upper tower portion with upwardly divergent compression cantilever members extending from near the lower end of the pier. Tension members are provided for interconnecting the ends of compression cantilever members on both sides of the tower.

Other objects, advantages and features of the invention will become apparent from the following detailed description thereof which is presented in conjunction with the accompanying drawing.

DETAILED DESCRIPTION OF EMBODIMENTS

Figure 1:
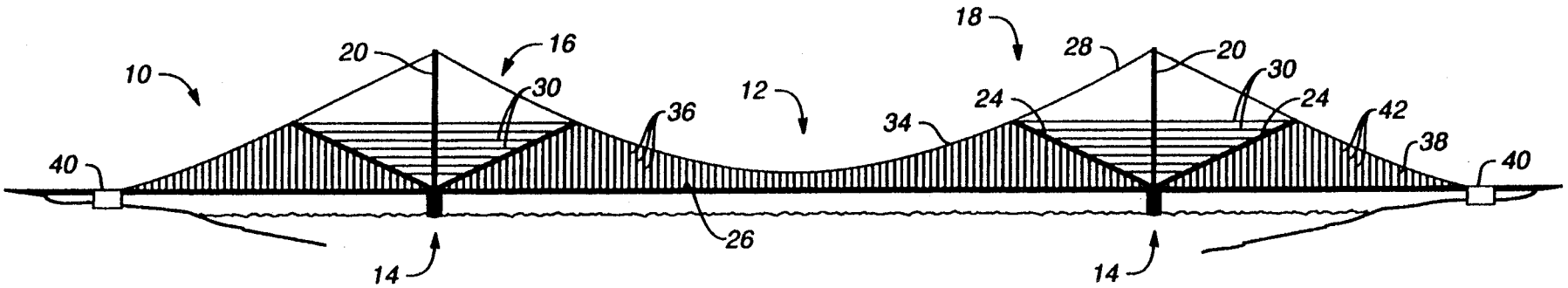
FIG. 1 a view in side elevation of a hybrid bridge embodying of the present invention.

With reference to the drawing, FIG. 1 shows a bridge 10 embodying principles of the present invention and comprising a central suspension section 12, in the center of one span between a pair of piers 14 and the cantilever sections 16 and 18, one at each end of the suspension section. The bridge 10 can have more than one span, but for purposes of illustration, it will be described in terms of a single span.

Each cantilever section is supported by a pier 14 which is built into the ground at the desired location. Firmly attached to and extending upwardly from the pier are two or more spaced apart towers 20 which are preferably connected at their upper ends by a cross member 22. At the lower end of each tower 20, just above the upper surface of the pier, are a pair of rigid compression members 24 which extend outwardly and upwardly at an angle with a bridge deck 26. The outer ends of each compression member 24 are connected by a tension member 28 (e.g. a cable) to the top of the tower 20 for the connected compression members. The towers and the compression members may be made of any suitable construction materials such as fabricated steel, pre-stressed concrete or a combination of both materials in accordance with known engineering principles. Additional tension members 30 connect both compression members together to counterbalance the tendency of the vertical loads imposed on the compression members to bend the members and redirect the load in the axial direction of the member. In the embodiment of FIG. 1 the additional tension members 30 are spaced apart vertically generally parallel to the bridge deck 26.

Figure 4:
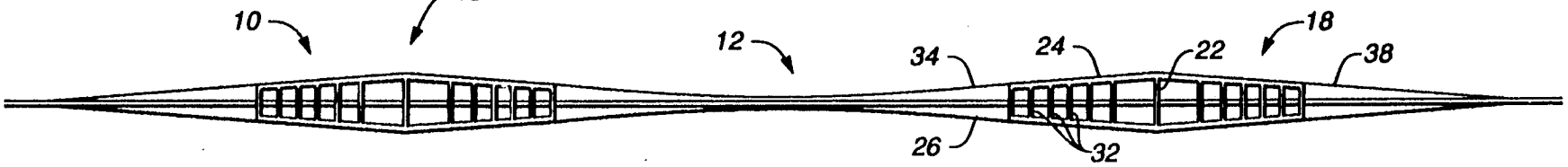
FIG. 4 is a plan view of the bridge shown in FIG. 1.

As shown in the plan view of FIG. 4 additional cross-members 32 which are spaced from and parallel to the upper cross member 22 are provided to interconnect opposite pairs of compression members for each cantilever section. As also shown in FIG. 4, the pairs of compression members 24 on each side of the towers 20 may converge toward each by a small predetermined angle as shown in FIG. 4. The reason for this is to provide an inclination to the suspenders 42 to enable them to help stabilize the bridge deck 26 under lateral wind forces. The compression members may also be parallel to each other if the alternative modified form is used.

The suspension section 12 for the bridge 10 comprises a pair of catenary cables 34 which are attached to the outer ends of the compression members 24 on the two spaced apart cantilever sections 16 and 18. Attached to these cables 34 are a plurality of vertical cable suspenders 36 which are connected to and support the bridge deck.

Attached to the outer ends of the compression members for each cantilever section at the end of a span are end cables 38 which extend to a suitable abutment anchor 40 that is usually formed on land at one end of the bridge. Here again, a series of vertical cable suspenders 42 are connected to the end cables 38 and to the bridge deck below.

Figure 2:
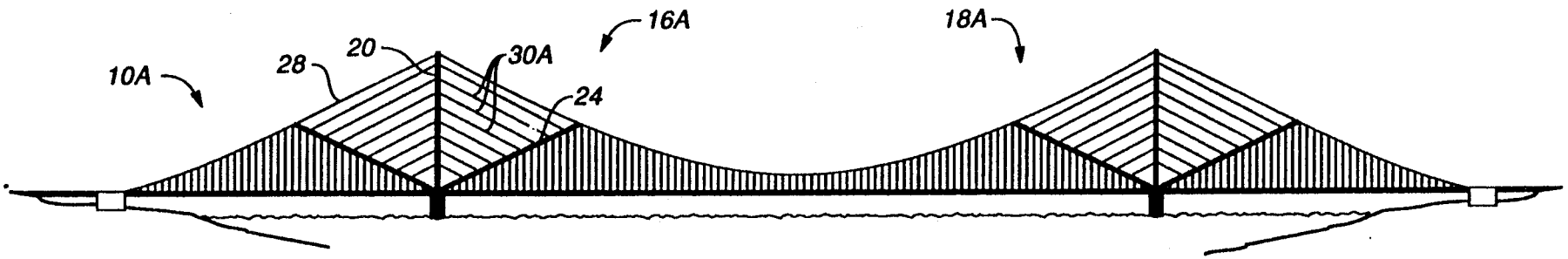
FIG. 2 is a view in side elevation of modified form of a hybrid bridge according to the invention.

FIG. 2 shows an alternate form of the invention, a hybrid bridge 10A utilizes modified cantilever sections 16A which are similar to the cantilever sections 16, except that additional tension members 30A are utilized which are spaced apart and are parallel to the tension members 28 that extend from the outer ends of the compression members 24A to the tops of the towers 20. While the structural integrity of this arrangement is essentially the same as the bridge of FIG. 1, a somewhat different construction procedure and aesthetic effect is afforded.

Figure 3:
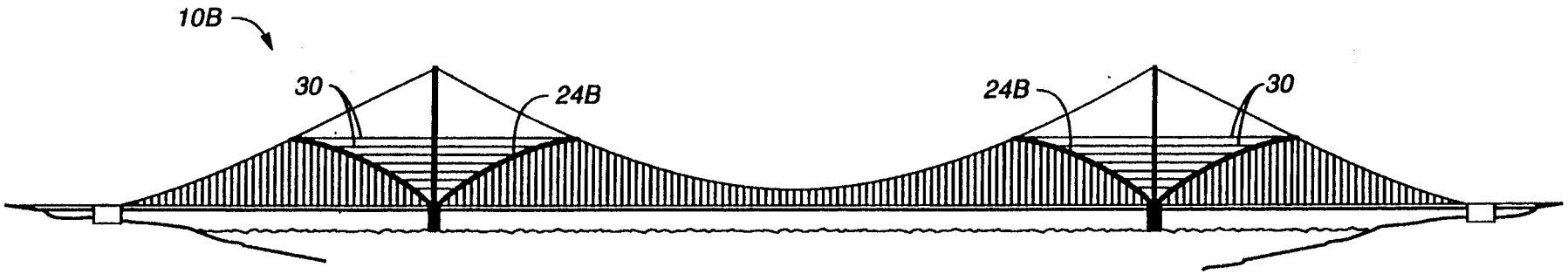
FIG. 3 is a view in side elevation of another modified form of a hybrid bridge according to the invention.

In yet another modified form of the hybrid bridge 10B shown in FIG. 3, compression members 24B are provided which are curved essentially to form an arch structure to transfer the loads imposed thereon axially to its supports at both ends.

Figure 5:
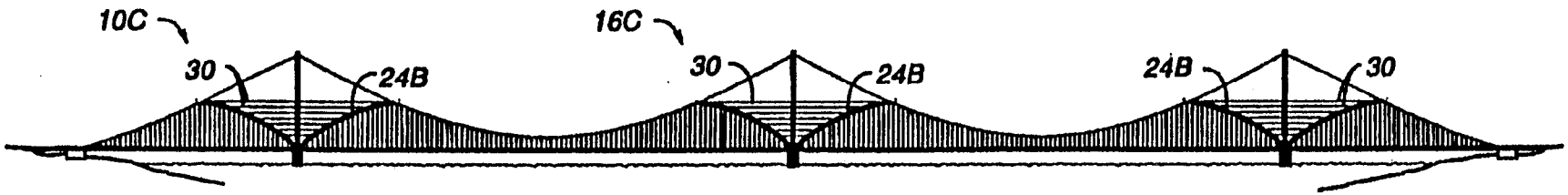
FIG. 5 is a view in side elevation of a multi-span bridge according to the present invention.
Figure 6:
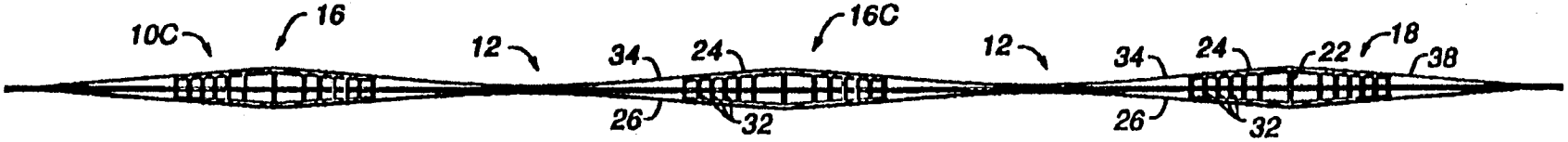
FIG. 6 is a plan view of the bridge shown in FIG. 5.

As stated previously, the invention may be applied to a bridge 10C having more than one span as shown in FIGS. 5 and 6. FIG. 5 shows an elevation view of the multi-span bridge 10C having double cantilever sections 16C similar to those shown for the bridge 10 in FIG. 1. FIG. 6 shows a plan view of the bridge 10C which utilizes the feature of converging catenary cables 34, as previously shown inn FIG. 4. Although only two spans are illustrated it should be apparent that a bridge of several spans supported by double cantilever sections could be constructed utilizing the principles of the invention.

To those skilled in the art to which this invention relates, many changes in construction and widely differing embodiments and applications of the invention will make themselves known without departing from the spirit and scope of the invention. The disclosure and the description herein are purely illustrative and are not intended to be in any sense limiting.

What is claimed is:

1. A hybrid bridge construction comprising:

a pair of piers enclosed in the earth at a fixed predetermined distance apart;

a balanced double cantilever section supported on each said pier, each cantilever section comprising one or more tower means extending vertically upward from each said pier and having a top portion, a pair of inner and outer rigid compression members each of equal length and weight, each said compression means being fixed to and extending upwardly and outwardly from the base of each said tower means at the same angle and having an upper end portion, and outer tension members attached to said top portions of said tower means and to said upper end portions of said compression members;

a suspension section interconnecting said cantilever sections and comprising catenary cable members attached to said upper end portions of said inner compression members;

a road deck extending between said piers; and vertical suspender members extending between said cable members and said road deck.

2. The bridge construction of claim 1 wherein said upper end portions of said outer compression members for at least one cantilever section are connected to ground-anchoring cable members connected to a ground support means.

3. The bridge construction of claim 1 wherein said upper end portions of said outer compression members for at least one cantilever section are connected to catenary cables of an adjacent span for the bridge.

4. The bridge construction of claim 1 wherein said compression members are straight.

5. The bridge construction of claim 1 wherein said compression members are purposely curved to form an arch structure.

6. The bridge construction of claim 1 wherein said compression members are made from prestressed concrete sections

7. The bridge construction of claim 1 wherein said cantilever sections are made from pre-fabricated steel members.

8. The bridge construction of claim 1 wherein said cantilever sections are made from a combination of concrete sections and pre-fabricated steel members.

9. The bridge construction of claim 1 including intermediate tension members on each said cantilever section extending between and connected at opposite ends to said compression members and said tower means.

10. The bridge construction of claim 9 wherein said intermediate tension members are spaced apart and generally parallel to said road deck.

11. The bridge construction of claim 9 wherein said intermediate tension members are spaced apart and generally parallel to said outer tension members.

12. The bridge construction of claim 1 wherein said tower means for each said cantilever section comprises a pair of vertical members connected by a horizontal cross member at their upper ends.

* * * * *